US008162027B2

(12) United States Patent
Archer

(10) Patent No.: US 8,162,027 B2
(45) Date of Patent: Apr. 24, 2012

(54) MULTI-FOLD DOOR

(76) Inventor: Andrew Archer, Toronto (CA)

( * ) Notice: Subject to any disclaimer, the term of this patent is extended or adjusted under 35 U.S.C. 154(b) by 332 days.

(21) Appl. No.: 12/461,387

(22) Filed: Aug. 11, 2009

(65) Prior Publication Data

US 2011/0036015 A1 Feb. 17, 2011

(51) Int. Cl.
*E05D 15/26* (2006.01)

(52) U.S. Cl. ..... 160/207; 160/205; 160/208; 160/213

(58) Field of Classification Search ..... 160/207, 160/208, 206, 213, 205, 210, 908, 62, 193, 160/201
See application file for complete search history.

(56) References Cited

U.S. PATENT DOCUMENTS

| | | | | | |
|---|---|---|---|---|---|
| 401,813 | A | * | 4/1889 | Bloom | 160/193 |
| 681,953 | A | | 9/1901 | Cross | |
| 821,201 | A | | 5/1906 | Taylor | |
| 1,893,147 | A | | 1/1933 | Oberdorfer | |
| 1,893,263 | A | | 1/1933 | Backes | |
| 1,937,730 | A | * | 12/1933 | Triller | 160/190 |
| 1,947,691 | A | | 2/1934 | Baldwin et al. | |
| 2,203,264 | A | | 6/1940 | Horstman | |
| 2,308,585 | A | | 1/1943 | Bowsher | |
| 2,366,793 | A | | 1/1945 | Kuehner | |
| 2,633,825 | A | * | 4/1953 | Smith et al. | 119/426 |
| 2,930,435 | A | | 3/1960 | Smith | |
| 2,945,536 | A | | 7/1960 | Smith | |
| 3,192,992 | A | | 7/1965 | Hasselmark | |
| 3,196,933 | A | | 7/1965 | Schneider | |
| 3,289,740 | A | * | 12/1966 | Heier, Jr. | 160/188 |
| 3,658,114 | A | | 4/1972 | Buehler | |
| D231,921 | S | * | 6/1974 | Rosenbaum | D25/49 |
| 3,871,278 | A | * | 3/1975 | Shoemaker | 105/378 |
| 4,026,343 | A | | 5/1977 | James | |
| 4,545,417 | A | | 10/1985 | Todd | |
| 6,079,762 | A | * | 6/2000 | Strasser | 296/36 |

* cited by examiner

*Primary Examiner* — Blair M. Johnson
(74) *Attorney, Agent, or Firm* — Riches, McKenzie & Herbert LLP

(57) ABSTRACT

The present invention provides a combination of a door and door frame defining a door opening. The door frame comprises a horizontal header beam. The door opening has a horizontal top side and a horizontal bottom side, with the horizontal header beam defining the horizontal top side. The door comprises a top panel, a middle panel, a bottom panel, a first horizontal hinge member, a second horizontal hinge member and a third horizontal hinge member, each panel having a horizontal upper edge and a horizontal lower edge. The door is in the closed position when the top panel, the middle panel and the bottom panel are vertically aligned with one another and hanging downwardly from the horizontal header beam in a vertical plane of the door opening, with the horizontal upper edge of each panel above the horizontal lower edge of each respective panel, and the horizontal lower edge of the bottom panel is located in the lowermost position proximate to the horizontal bottom side of the door opening. The door is in the open position when the horizontal lower edge of the bottom panel is located in the uppermost position proximate to the horizontal header beam, with both the top panel and the bottom panel disposed above the middle panel.

18 Claims, 7 Drawing Sheets

306
308
106
350
210
300
202
104
212
230
250
252
204
214
232
206
302

306
308
106
350
210
202
300
212
230
250
302
252
204
206
232
214
104

MULTI-FOLD DOOR

SCOPE OF THE INVENTION

The present invention relates to doors, and in particular, to multi-fold doors used for controlling access to buildings.

BACKGROUND OF THE INVENTION

Doors are known devices which are used to control access to buildings such as garages, warehouses and barns. Doors can be in a closed position, thus preventing access to the building. Doors can also be moved to an open position, thus allowing access to the building.

Known prior art doors include single panel doors. One example is a hydraulic door 10 having a single panel 12, as shown in FIG. 1. In the closed position, the single panel 12 lies vertically in the plane of the door opening 14. To open the door 10, hydraulic cylinders 16 are used to raise the entire single panel 12 away from the door opening 14 until the panel 12 is almost or completely perpendicular to the plane of the door opening 14, as shown in FIG. 1. To open such a door 10, this single panel 12 needs to swing in a very large arc or radius which can interfere with objects outside the building such as parked cars. Furthermore, when in the open position, the single panel 10 is supported at only one end 18 and forms a cantilvered mass. The single panel 12 will be subject to torque about end 18 in the counterclockwise direction. Therefore, the panel 12 will tend to swing back into the closed position. The torque will increase as the mass of the panel 12 increases. Doors for larger buildings, such as warehouses and barns, are often very heavy, generally weighing ½ ton to 1 ton or more. Therefore, extensive support structure is often required to maintain this single panel 12 in the open cantilevered position. The installation of the necessary support structure, especially for older buildings, requires extensive and costly renovation. For example, the door frame defining the door opening may be made of material that is not strong enough to support a cantilevered door, and therefore, would need to be replaced with a door frame made of stronger material.

Other known doors include single panel doors, where the single panel moves into the interior of the building when in an open position. Specifically, the single panel moves into and is supported by an overhead guide rail which is fitted into the interior of the building. The installation of such overhead guide rails is costly, and the overhead guide rails waste vertical space in the building.

Known doors also include bi-fold doors 50, as shown in FIG. 2. These doors 50 have an upper panel 52 and a lower panel 54 which are pivotally connected to each other by a hinge 56. When in a closed position, the upper panel 52 and the lower panel 54 of the bi-fold door 50 lie vertically in the plane of the door opening 58, with the upper panel 52 directly above the lower panel 54. To open the door 50, the upper panel 52 and the lower panel 54 pivot towards each other about the hinge 56 until the upper panel 52 is disposed in a position almost flat on top of the lower panel 54. When in an open position, the upper panel 52 lies almost flat on top of the lower panel 54. There is a cantilevered mass because the upper panel 52 and the lower panel 54 are only supported at one end 60. There is a tendency for the upper panel 52 and the lower panel 54 to unfold or sag back into the closed position. The upper panel 52 is subject to torque about end 60 in the clockwise direction, and therefore, will push downwards on the lower panel 52 which leads to unfolding or sagging. A significant amount of structural support is often required to keep such bi-fold doors in the open position. As mentioned above, doors often weigh ½ ton to 1 ton or more.

SUMMARY OF THE INVENTION

To at least partially overcome the disadvantages of previously known doors, the present invention provides a new door.

An object of the present invention is to provide an improved door for controlling access to buildings, such as garages, warehouses and barns.

Another object of the present invention is to provide a door which can be installed to doorway openings of many different sizes.

A further object of the present invention is to provide a door where installation of the door only requires a minimal amount of support structure to be implemented.

Yet another object of the present invention is to provide a door which does not require an overhead guide rail inside the building or for a large counterweight to be attached to the top panel.

A further object of the present invention is to provide a door which opens without swinging in a large arc or radius.

Yet another object of the present invention is to provide a door which, when in an open position, does not have a cantilevered mass and therefore, does not tend to sag or unfold into the closed position.

The present invention provides a novel door. In one aspect, the present invention provides a multi-fold door for controlling access to buildings such as garages, warehouses and barns.

In one aspect, the present invention provides a combination of a door and door frame defining a door opening, the door frame comprising a horizontal header beam, the door opening having a horizontal top side and a horizontal bottom side, with the horizontal header beam defining the horizontal top side, the door comprising a top panel, a middle panel, a bottom panel, a first horizontal hinge member, a second horizontal hinge member and a third horizontal hinge member, each panel having a horizontal upper edge and a horizontal lower edge, the horizontal upper edge of the top panel is pivotally connected to the horizontal header beam by the first horizontal hinge member, the horizontal lower edge of the top panel is pivotally connected to the horizontal upper edge of the middle panel by the second horizontal hinge member, the horizontal upper edge of the bottom panel is pivotally connected to the horizontal lower edge of the middle panel by the third horizontal hinge member, wherein the door is movable between an open position with the horizontal lower edge of the bottom panel in an uppermost position and a closed position with the horizontal lower edge of the bottom panel in a lowermost position, the door is in the closed position when the top panel, the middle panel and the bottom panel are vertically aligned with one another and hanging downwardly from the horizontal header beam in a vertical plane of the door opening, with the horizontal upper edge of each panel above the horizontal lower edge of each respective panel, and the horizontal lower edge of the bottom panel is located in the lowermost position proximate to the horizontal bottom side of the door opening, the door is in the open position when the horizontal lower edge of the bottom panel is located in the uppermost position proximate to the horizontal header beam, with both the top panel and the bottom panel disposed above the middle panel.

In another aspect, the present invention provides a door for use with a door opening, the door opening having a horizontal top side and a horizontal bottom side, with a horizontal header beam defining the horizontal top side, the door comprising a top panel, a middle panel, a bottom panel, a first horizontal hinge member, a second horizontal hinge member and a third horizontal hinge member, each panel having a horizontal upper edge and a horizontal lower edge, the horizontal upper edge of the top panel is pivotally connected to the horizontal header beam by the first horizontal hinge member, the horizontal lower edge of the top panel is pivotally connected to the horizontal upper edge of the middle panel by the second horizontal hinge member, the horizontal upper edge of the bottom panel is pivotally connected to the horizontal lower edge of the middle panel by the third horizontal hinge member, wherein the door is movable between an open position with the horizontal lower edge of the bottom panel in an uppermost position and a closed position with the horizontal lower edge of the bottom panel in a lowermost position, the door is in the closed position when the top panel, the middle panel and the bottom panel are vertically aligned with one another and hanging downwardly from the horizontal header beam in a vertical plane of the door opening, with the horizontal upper edge of each panel above the horizontal lower edge of each respective panel, and the horizontal lower edge of the bottom panel is located in the lowermost position proximate to the horizontal bottom side of the door opening, the door is in the open position when the horizontal lower edge of the bottom panel is located in the uppermost position proximate to the horizontal header beam, with both the top panel and the bottom panel disposed above the middle panel.

Preferably, the mass of the top panel is equal to the mass of the bottom panel, and the mass of each panel is evenly distributed between its horizontal upper edge and its horizontal lower edge.

Preferably, the length from the horizontal upper edge of the top panel to the horizontal lower edge of the top panel is equal to the length from the horizontal upper edge of the bottom panel to the horizontal lower edge of the bottom panel. It is also preferred that the length from the horizontal upper edge of the middle panel to the horizontal lower edge of the middle panel is no more than twice the length from the horizontal upper edge of the top panel to the horizontal lower edge of the top panel.

Preferably, when the door is in the open position, a structural load of the door on one side of the door opening balances a structural load of the door on the other side of the door opening.

When the door is in the open position, there is preferably a net torque of 0 about the first hinge member pivotally connecting the horizontal upper edge of the top panel to the horizontal header beam.

When in the closed position, all three panels lie vertically in the vertical plane of the door opening, with the top panel directly above the middle panel, and the middle panel directly above the bottom panel. When in the open position, both the top panel and the bottom panel have been pivoted so that they are disposed above the middle panel to form a generally triangular shape. The middle panel lies in a horizontal plane and forms a bottom side of the generally triangular shape. The horizontal upper edge of the top panel is proximate to the horizontal lower edge of the bottom panel to form a top vertex of the generally triangular shape.

Preferably, there is a guide track system to assist in guiding the door between the open position and the closed position. The door frame comprises two vertical door jambs which are spaced apart from each other, with the horizontal header beam extending between upper ends of the two vertical door jambs. The door frame further comprises two vertically extending tracks, with one of the vertically extending tracks mounted on each vertical door jamb. Each vertically extending track preferably forms an elongated C-shaped or U-shaped channel. The door comprises two guide members mounted on the middle panel, with one of the guide members being retained by each vertically extending track and vertically movable in the vertically extending track.

In order to effect the movement of the panels between the open and closed positions, there are preferably one or more elongate tensioning members, the elongate tensioning member being mounted at one end proximate to the horizontal lower edge of the bottom panel of the door and engaged at the other end proximate to the horizontal header beam, wherein reducing the length of the elongate tensioning member between the lower edge of the bottom panel and the horizontal header beam draws the horizontal lower edge of the bottom panel from the lowermost position to the uppermost position, and moves the door from the closed position to the open position. The elongate tensioning member is preferably a cable or chain or strap.

By pulling upwards on the elongate tensioning member, the attached bottom panel is raised upwards and away from the door opening to begin the opening of the door. More preferably, an electric motor provides the mechanical energy needed to pull the elongate tensioning member upwards.

In an alternative embodiment, the door has four or more panels. When the door has four panels, there is a top panel, two middle panels, and a bottom panel. When in the closed position, all four panels lie vertically in the plane of the door opening. When in the open position, both the top panel and the bottom panel have been pivoted so that they are disposed above both of the two middle panels to form the shape of a diamond, where the horizontal upper edge of the top panel and the horizontal lower edge of the bottom panel are proximate to each other to form the top vertex of the diamond.

BRIEF DESCRIPTION OF THE DRAWINGS

Further aspects and advantages will become apparent from the following description taken together with the accompanying drawings in which:

FIG. 7 illustrates a fully closed position and FIG. 11 illustrates a fully open position.

Throughout all the drawings and the disclosure, similar parts are indicated by the same reference numerals.

DESCRIPTION OF THE PREFERRED EMBODIMENTS

Reference is made to FIGS. 3 to 11 which show preferred embodiments of the present invention.

Figure 3:
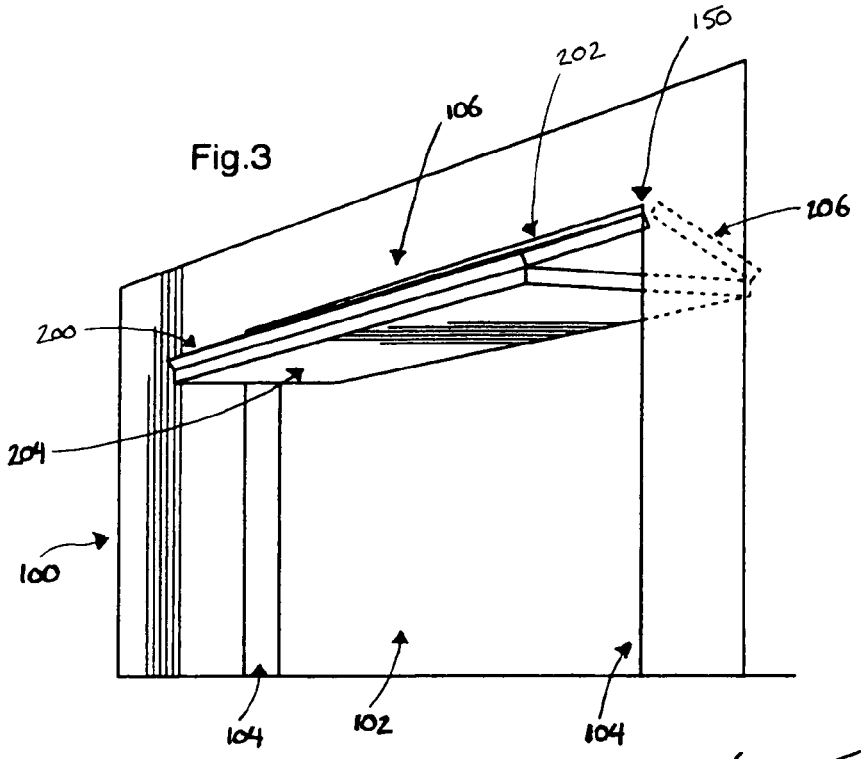
FIG. 3 is a perspective view of a door in accordance with a preferred embodiment of the present invention, where the door is in an open position.
Figure 4:
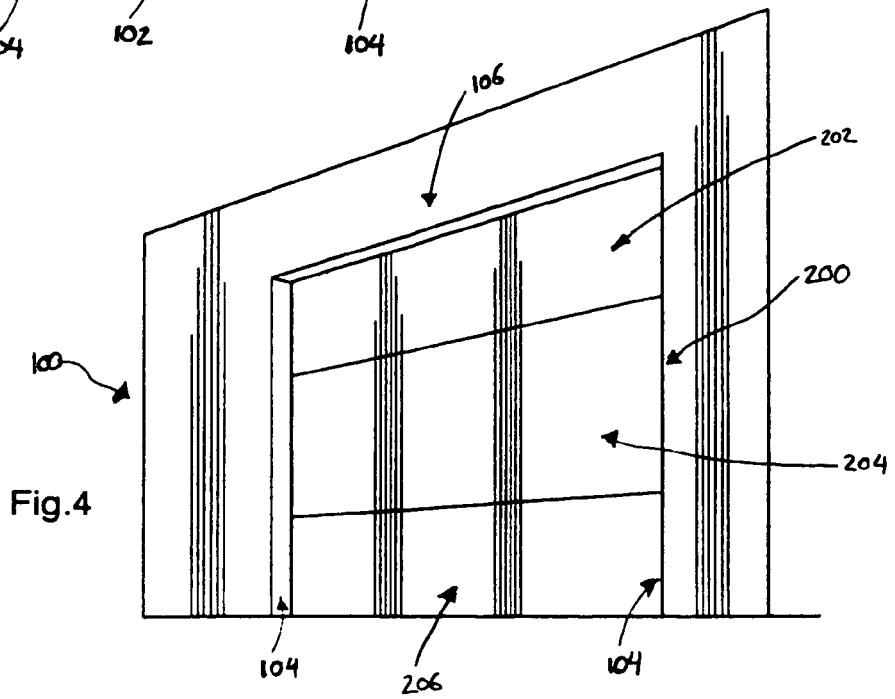
FIG. 4 is a perspective view of the door shown in FIG. 3, where the door is in a closed position.

FIGS. 3 and 4 illustrate a preferred embodiment of the present invention. A door frame 100 defines a door opening 102. The door frame 100 comprises two vertical door jambs 104. The vertical door jambs 104 are spaced apart from each other, as shown in FIG. 3. The door frame 100 also comprises a horizontal header beam 106. The horizontal header beam 106 extends between the upper ends of the two vertical door jambs 104. The vertical door jambs 104 and the horizontal header beam 106 define the door opening 102.

In the preferred embodiment shown in FIGS. 3 and 4, there is a door 200. The door 200 is a trifold door 200 comprising three panels, namely a top panel 202, a middle panel 204, and a bottom panel 206. Preferably, the mass of the top panel 202 is equal to the mass of the bottom panel 206. Preferably, the mass of each panel 202, 204 and 206 is evenly distributed between its horizontal upper edge and its horizontal lower edge.

The three panels 202, 204 and 206 can be preferably made of any materials which are commonly used for large doors, such as steel, aluminium, wood and vinyl.

The panels 202, 204 and 206 can be of any size. More specifically, the panels 202, 204 and 206 can be sized to accommodate door openings of any size, including door openings which are for larger buildings such as garages, barns and warehouses.

The top panel 202 and the bottom panel 206 are preferably the same size. Specifically, the length from the horizontal upper edge of the top panel 202 to the horizontal lower edge of the top panel 202 is equal to the length from the horizontal upper edge of the bottom panel 206 to the horizontal lower edge of the bottom panel 206.

The length from the horizontal upper edge of the middle panel 204 to the horizontal lower edge of the middle panel 204 is preferably no more than twice the corresponding length in either the top panel 202 or the bottom panel 206. In one preferred embodiment, all of the top panel 202, middle panel 204 and bottom panel 206 are of the same size and length.

In the closed position shown in FIG. 4, all of the top panel 202, middle panel 204, and bottom panel 206 are vertically aligned with one another, and hang downwardly from the horizontal header beam 106 in the vertical plane of the door opening 102. The top panel 202 is directly above the middle panel 204, and the middle panel 204 is directly above the bottom panel 206. The horizontal upper edge of each panel is above the horizontal lower edge of each respective panel. In this closed position, the door 200 prevents access through the door opening 102.

In the open position illustrated in FIG. 3, the panels 202, 204 and 206 have been raised to an elevated position, thus allowing access through the door opening 102. Specifically, both the top panel 202 and the bottom panel 206 are raised such that they are disposed above the middle panel 204 to form a generally triangular shape. The middle panel 204 lies in a horizontal plane and forms the bottom side of the generally triangular shape. The horizontal upper edge of the top panel 202 is proximate to the horizontal lower edge of the bottom panel 206 to form the top vertex of the generally triangular shape.

In the open position shown in FIG. 3, there is no net torque about point 150. The mass of the top panel 202, which is to the left of point 150 and outside the door opening, is equal to the mass of the bottom panel 206, which is to the right of point 150 and inside the door opening. The structural load to the left of point 150, which is on the outside of the door opening 102, balances the structural load to the right of point 150, which is on the inside of the door opening 102. There is no tendency for the opened door 200 to sag or unfold.

Figure 5:
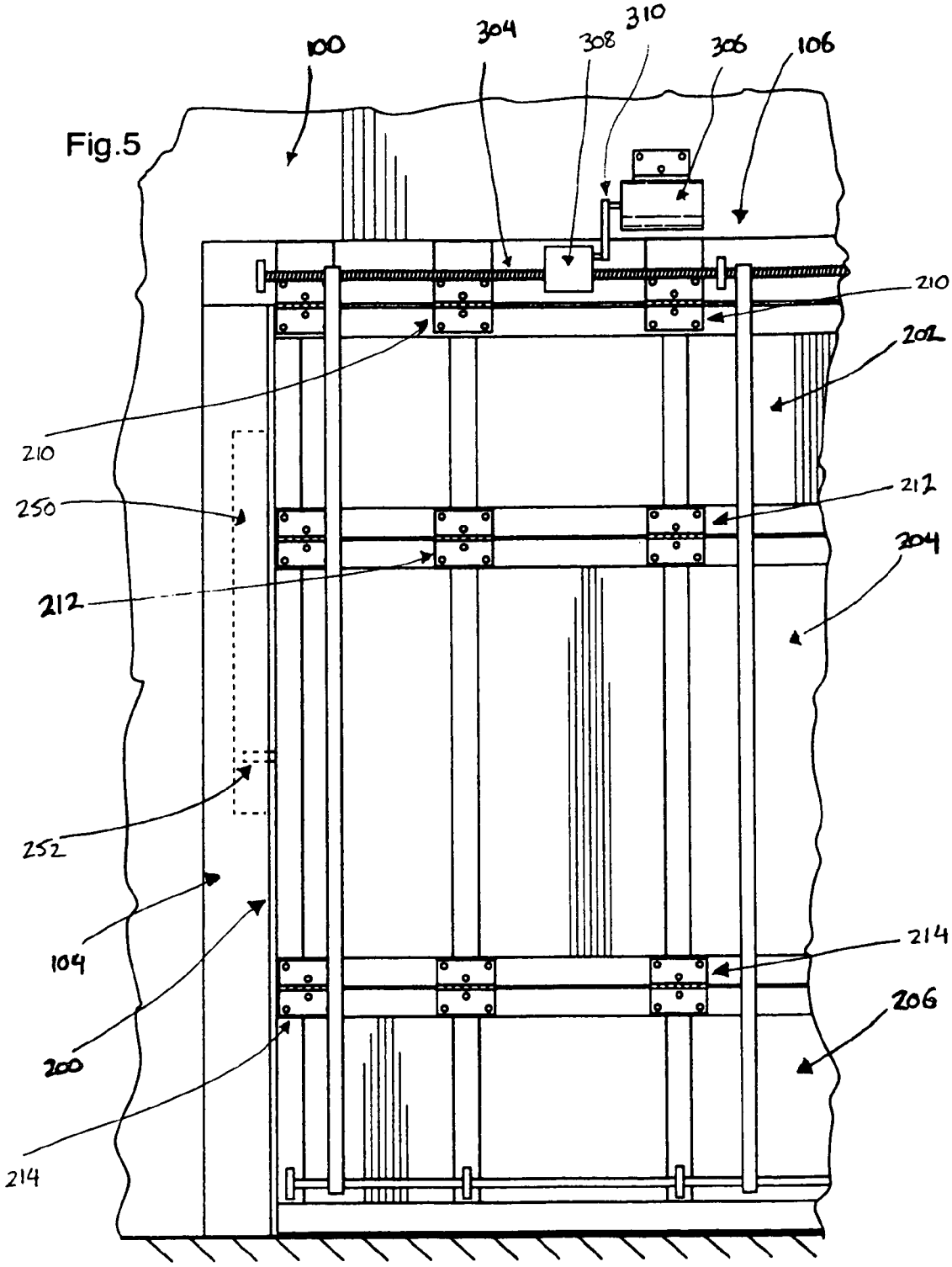
FIG. 5 is a partial view of the interior side of a door in accordance with another preferred embodiment of the present invention.
Figure 6:
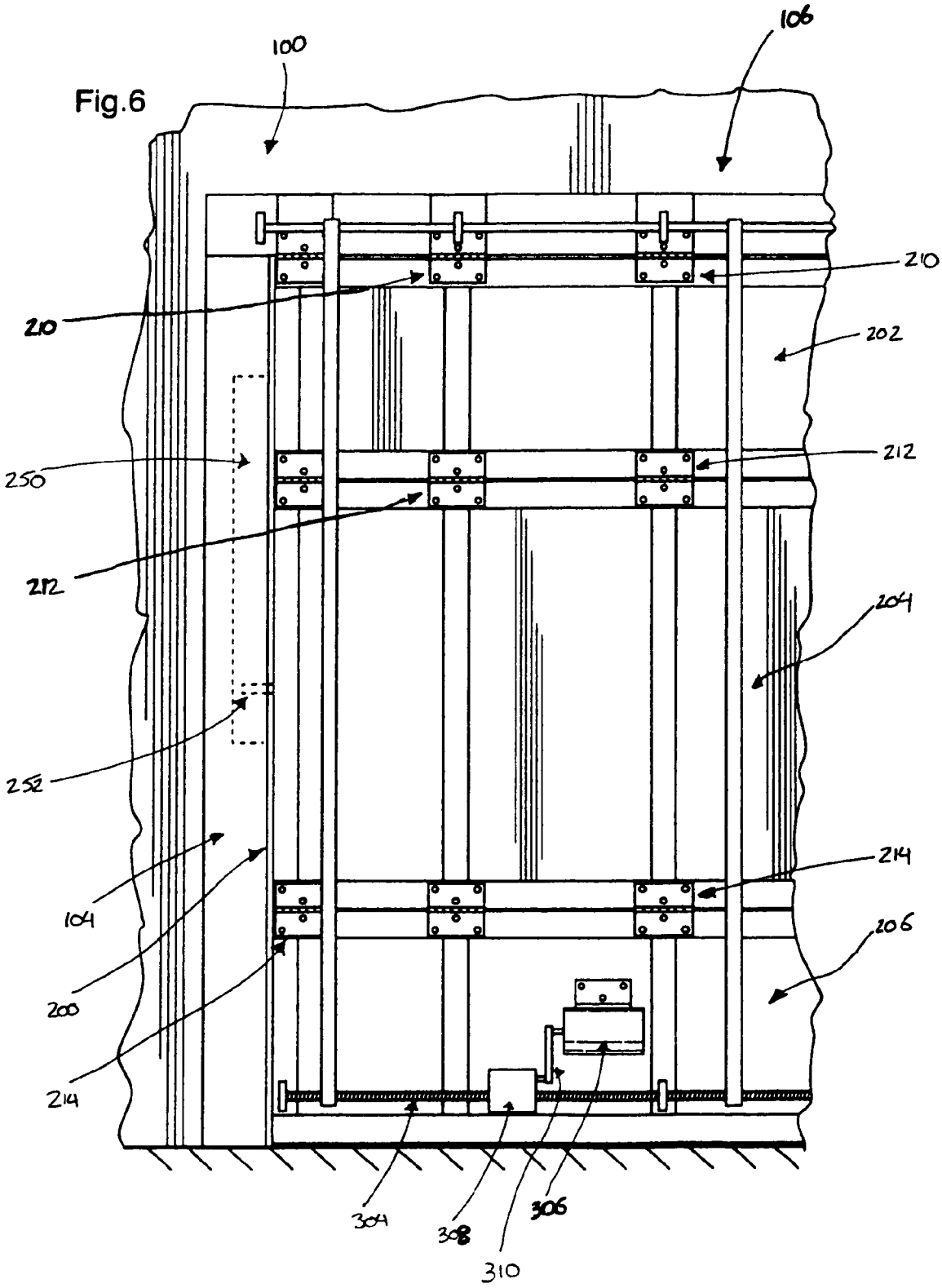
FIG. 6 is a partial view of the interior side of a door in accordance with another preferred embodiment of the present invention.

As shown in FIGS. 5 and 6, horizontal hinge members 210 pivotally connect the horizontal upper edge of the top panel 202 to the horizontal header beam 106. The top panel 202 can pivot about horizontal hinge members 210.

Horizontal hinge members 212 pivotally connect the horizontal lower edge of top panel 202 to the horizontal upper edge of middle panel 204. The top panel 202 and the middle panel 204 can pivot about horizontal hinge members 212, and therefore, are able to pivot towards each other or away from each other. As shown in FIGS. 7 to 11, a drip edge 230 preferably extends from the horizontal lower edge of the top panel 202 to cover horizontal hinge members 212.

Horizontal hinge members 214 pivotally connect the horizontal lower edge of middle panel 204 to the horizontal upper edge of bottom panel 206. The middle panel 204 and the bottom panel 206 can pivot about horizontal hinge members 214, and therefore, are able to pivot towards each other or away from each other. As shown in FIGS. 7 to 11, a drip edge 232 preferably extends from the horizontal lower edge of the middle panel 204 to cover horizontal hinge members 214.

Figure 7:
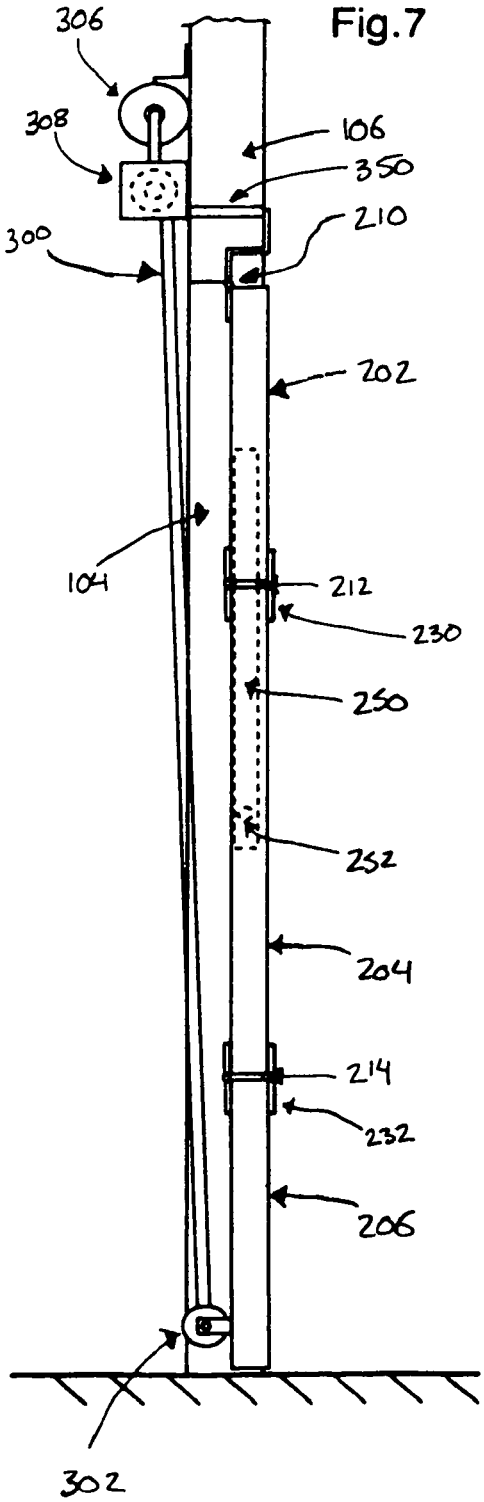
FIGS. 7 to 11 are side views of the door shown in FIG. 3 in five different stages of opening the door, where

The opening of the trifold door 200 is illustrated in five stages in FIG. 7 to 11. FIG. 7 illustrates the trifold door 200 in a fully closed position. The door 200, including all three panels 202, 204 and 206, hangs downwardly from the horizontal header beam 106 and lies vertically in the plane of the door opening 102. The top panel 202 lies directly above the middle panel 204, and the middle panel 204 lies directly above the bottom panel 206. The horizontal lower edge of the bottom panel 206 is located in a lowermost position proximate to the horizontal bottom side of the door opening 102.

Figure 8:
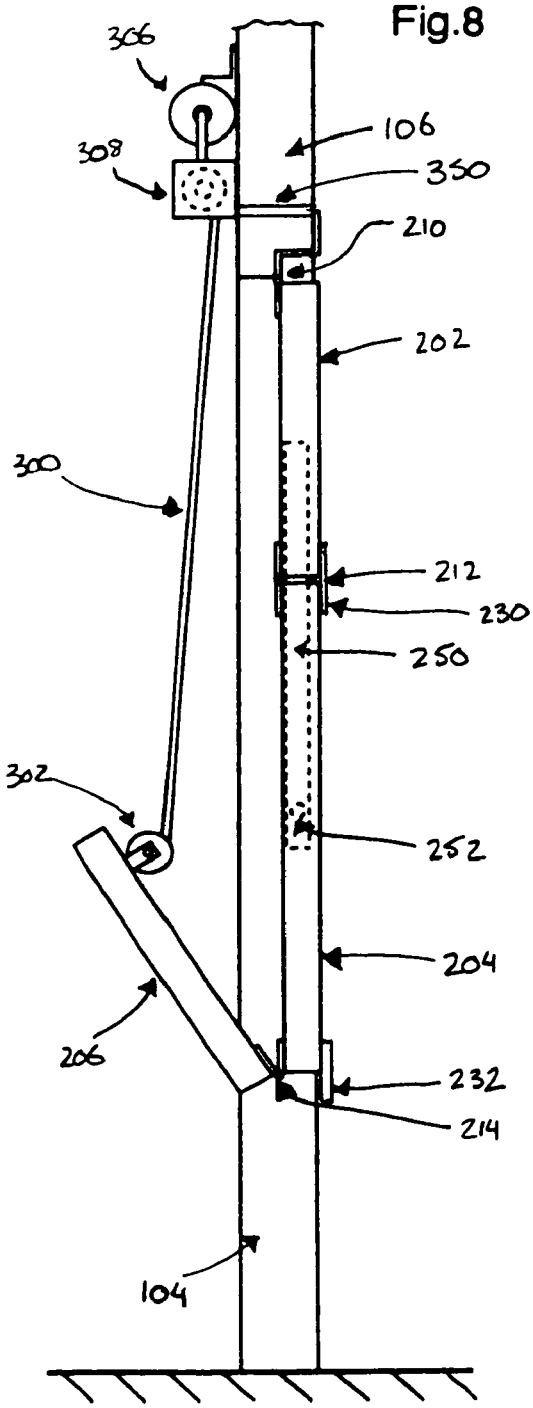

As shown in FIG. 8, to begin opening the trifold door 200, the bottom panel 206 is raised upwards and away from the door opening 102, such that it pivots about horizontal hinge member 214 towards the middle panel 204. In the preferred embodiment shown in the drawings, the bottom panel 206 is raised towards the inside of the building.

Figure 9:
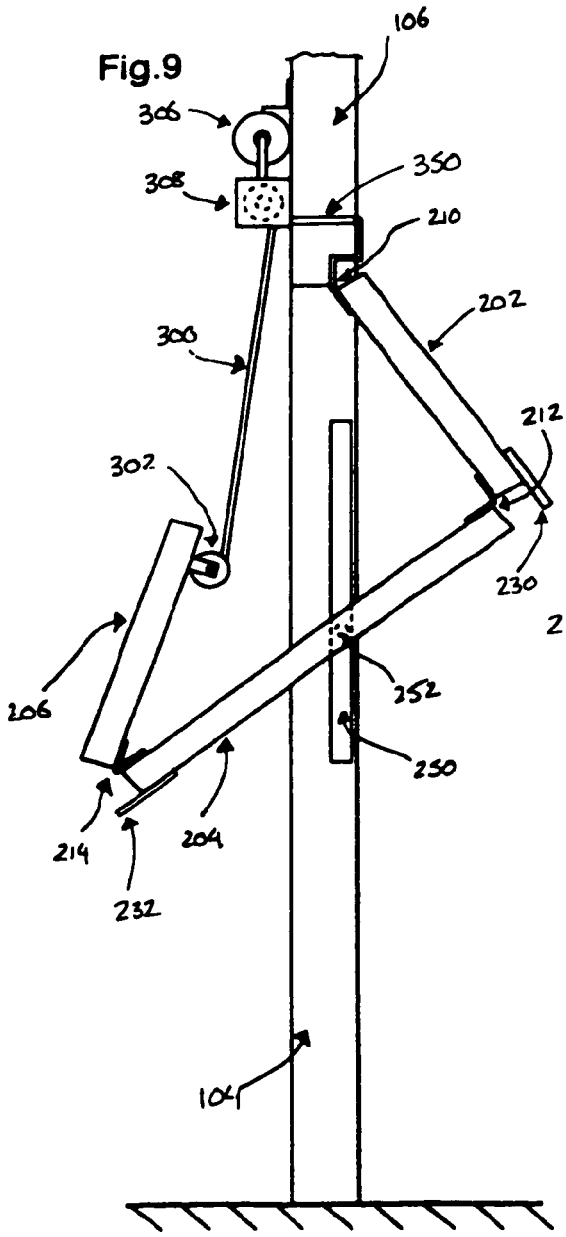

In FIG. 9, the top panel 202 and the middle panel 204 begin to pivot towards each other about horizontal hinge members 212. The top panel 202 and the middle panel 204 extend away from the door opening 102 in a direction opposite to which the bottom panel 206 extends away from the door opening 102. In the preferred embodiment shown in the drawings, the top panel 202 and the middle panel 204 extend towards the outside of the building.

Figure 10:
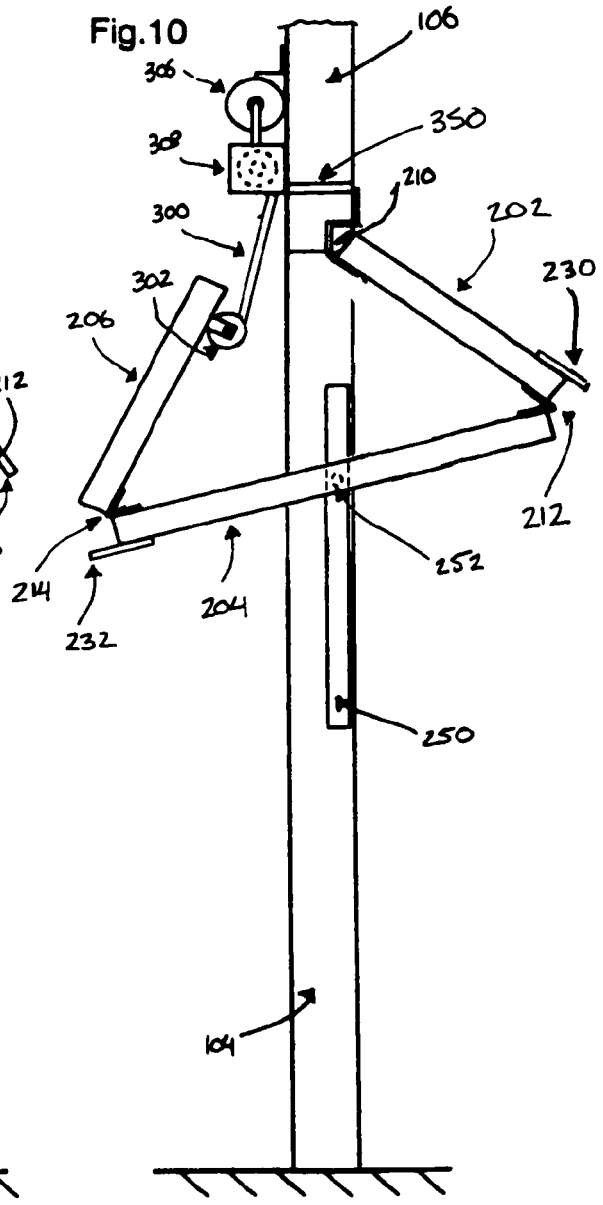

As shown in FIG. 10, the top panel 202 and the middle panel 204 continue to pivot towards each other. The horizontal lower edge of the bottom panel 206 moves closer to the horizontal upper edge of the top panel 202.

Figure 11:
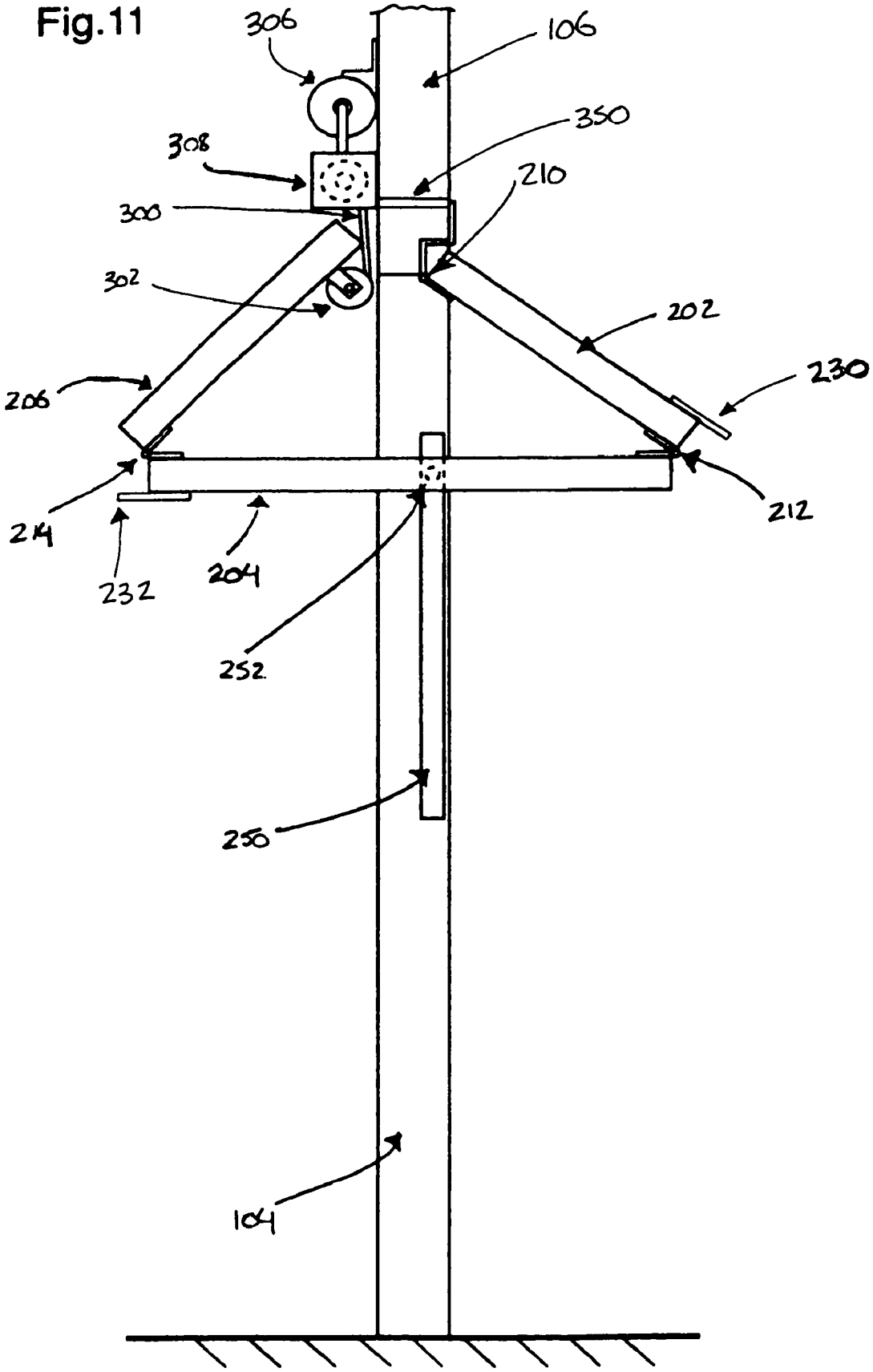

FIG. 11 illustrates a fully open position for the door 200. Both the top panel 202 and the bottom panel 206 are disposed above the middle panel 204 such that all three panels 202, 204 and 206 form a generally upright triangular shape. The middle panel 204 lies in a horizontal plane and forms the bottom side of the upright triangular shape. The horizontal lower edge of the bottom panel 206 is located in an uppermost position proximate to the horizontal upper edge of the top panel 202 to form a top vertex of the upright triangular shape.

To ensure that the door moves correctly between the closed position, as shown in FIG. 4, to the open position, as shown in FIG. 3, and vice versa, a guide track system is preferably provided. As shown in FIGS. 5 and 6, a vertically extending track 250 is mounted on the door jambs 104. The track 250 may be configured as an elongated C-shaped or V-shaped channel. A corresponding guide member 252 is mounted on the side edge of the middle panel 204. The guide member 252 may be a pin or roller which is adapted for vertical movement in and retention by the channel of vertically extending track 250. The guide track system guides the movement of the panels 202, 204 and 206 between the open and closed positions and also prevents outwardly swinging movements of the panels 202, 204 and 206.

As shown in FIG. 7, when the door 200 is in the closed position, the guide member 252 is near the bottom of the track 250.

As shown in FIGS. 9 and 10, as the door 200 is being moved to an open position, and the middle panel 204 is being pivoted from a vertical position to a horizontal position, the guide member 252 moves upwards in the vertical track 250.

As shown in FIG. 11, when the door 200 is in an open position, the guide member 252 has moved to near the top of the track 250.

In the preferred embodiment, the mechanism for moving the door 200 between a closed position and an open position is effected by an electric motor system which includes a cable 300, a bracket 302, a drive shaft 304, an electric motor 306, a gearbox 308, and a roller chain 310. In an alternative embodiment, the cable 300 is substituted with a chain. In another alternative embodiment, the roller chain 310 is substituted with a belt drive.

In the preferred embodiment shown in FIG. 5, the drive shaft 304, the electric motor 306, the gearbox 308 and the roller chain 310 are mounted to the horizontal header beam 104. The bracket 302 is mounted to bottom panel 206.

In the preferred embodiment shown in FIG. 6, the drive shaft 304, the electric motor 306, the gearbox 308 and the roller chain 310 are mounted to the bottom panel 206. The bracket 302 is mounted to the horizontal header beam 104.

FIGS. 7 to 11 illustrate the preferred embodiment of FIG. 5, where the drive shaft 304, the electric motor 306, the gearbox 308 and the roller chain 310 are mounted to the horizontal header beam 106 and the bracket 302 is mounted to the bottom panel 206.

The cable 300 is attached at one end to the bracket 302, which is mounted to the bottom panel 206. At the other end, the cable 300 is engaged to the drive shaft 304.

The electric motor 306 provides mechanical energy to rotate the roller chain 310. The roller chain transmits the mechanical energy to the gearbox 308, causing the gear of the gearbox 308 to rotate. The gear of the gearbox 308 frictionally engages the drive shaft 304, preferably by teeth or cogs. The gearbox 308 transmits mechanical energy from the motor 306 as rotational torque to the drive shaft 304 to rotate the drive shaft 304. The rotation of the drive shaft 304 pulls upwards on the attached cable 300, causing the cable 300 to wrap around the drive shaft 304, thus shortening the length of free cable 300.

As shown in FIG. 8, the pulling of the cable 300 upwards causes the attached bottom panel 206 to pivot about horizontal hinge member 214 and to be raised upwards and away from the door opening 102. The cable 300 is pulled upwards until the attached bottom panel 206 is raised above the middle panel 204 into the closed position shown in FIG. 11.

The electric motor system is adapted to rotate the drive shaft 304 in either the clockwise or counterclockwise directions. As such, the drive shaft 304 can be rotated in one direction to pull upwards on the cable 300 so that the cable 300 wraps around the drive shaft 304, as described above, and also rotated in the opposite direction to unwrap the cable 300 from the drive shaft 304. Unwrapping the cable 300 from the drive shaft 304 will extend the length of free cable 300 and allow the bottom panel 206 to pivot about horizontal hinge member 214 and to be lowered to begin closing the door 200.

An attachment such as a bolt 350 extends from horizontal hinge member 210 to the drive shaft 304. The bolt 350 allows structural loads to pass through the horizontal header beam 106.

In the open position shown in FIG. 11, there is a net torque of 0 about hinge member 210. The mass of the bottom panel 206, which is to the left of horizontal hinge member 210 and inside the door opening 102, is equal to the mass of the top panel 202, which is to the right of horizontal hinge member 210 and outside the door opening 102. The structural load to the left of horizontal hinge member 210, which is inside the door opening 102, balances the structural load to the right of horizontal hinge member 210, which is outside the door opening 102. As such, there is no tendency for the opened door 200 to sag or unfold.

Figure 1:
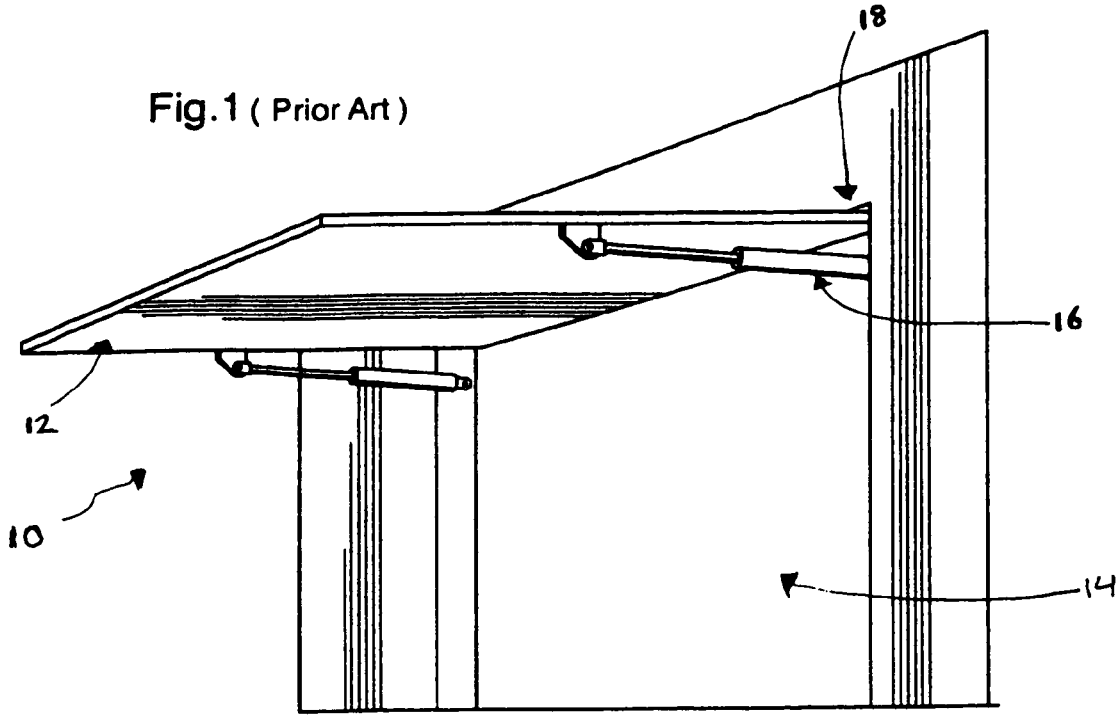
Fig.1 ( Prior Art )
FIG. 1 is a perspective view of a prior art hydraulic door having a single panel.
Figure 2:
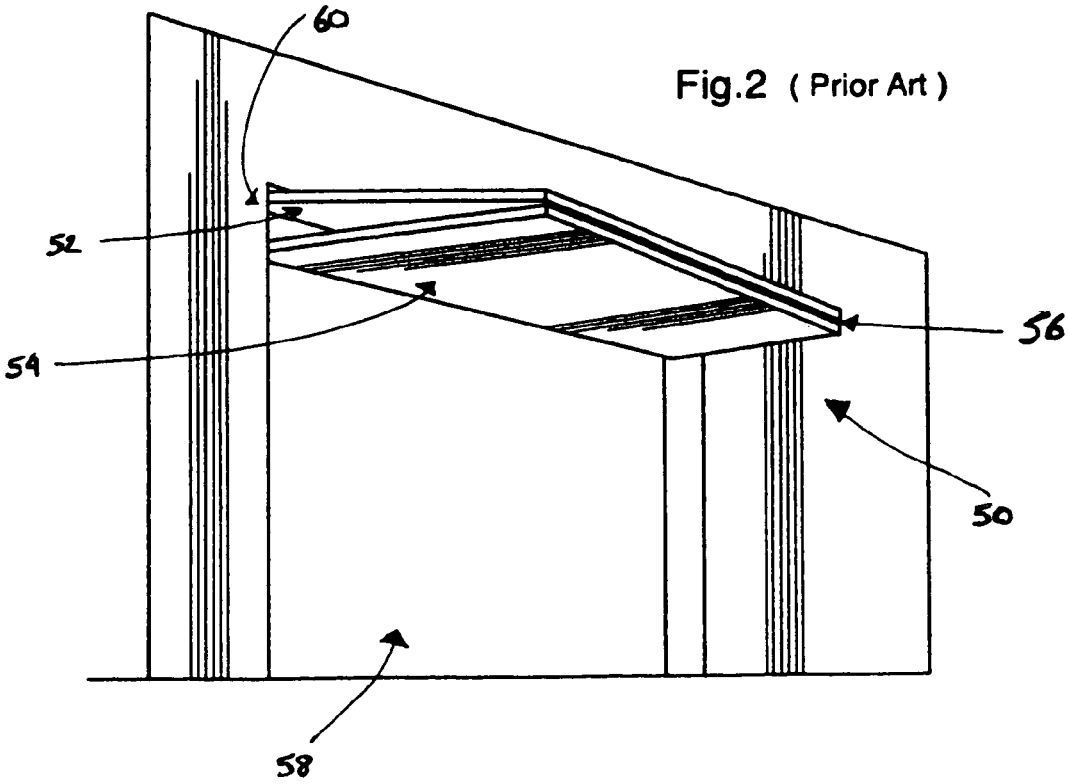
Fig.2 ( Prior Art )
FIG. 2 is a perspective view of a prior art bi-fold door.

The door 200 does not require a significant amount of structural support that cantilevered doors, such as those prior art doors shown in FIGS. 1 and 2, require. Because there is no net torque in the open position, significantly less renovation work needs to be done to the door frame 100 to provide the necessary structural support for the installation of the door 200 of the present invention.

Unlike prior art doors, there is no requirement for an overhead guide rail inside the building or for a large counterweight to be attached to the top panel 202.

As shown in FIGS. 7 to 11, moving the door 200 to an open position is done without having to swing the door 200 in a large arc or radius, as in the prior art single panel doors. As such, the opening and closing of the door 200 of the present invention does not tend to interfere with objects which are outside the door opening 102, such as parked cars.

Although this disclosure has described and illustrated preferred embodiments of the invention, it is to be understood that the invention is not restricted to these particular embodiments. Rather, the invention includes all embodiments that are functional or mechanical equivalents of the specific embodiments and features that have been described and illustrated herein. Many modifications will now occur to those skilled in the art. For a definition of the invention, reference is made to the following claims.

I claim:

1. A combination of a door and doorframe defining a door opening, the doorframe comprising a horizontal header beam, the door opening having a horizontal top side and a horizontal bottom side, with the horizontal header beam defining the horizontal top side, the door comprising a top panel, a middle panel, a bottom panel, a first horizontal hinge member, a second horizontal hinge member and a third horizontal hinge member, each panel having a horizontal upper edge and a horizontal lower edge, the horizontal upper edge of the top panel is pivotally connected to the horizontal header beam by the first horizontal hinge member, the horizontal lower edge of the top panel is pivotally connected to the horizontal upper edge of the middle panel by the second horizontal hinge member, the horizontal upper edge of the bottom panel is pivotally connected to the horizontal lower edge of the middle panel by the third horizontal hinge member, wherein the door is movable between an open position with the horizontal lower edge of the bottom panel in an uppermost position and a closed position with the horizontal lower edge of the bottom panel in a lowermost position, the door is in the closed position when the top panel, the middle panel and the bottom panel are vertically aligned with one another and hanging downwardly from the horizontal header beam in a vertical plane of the door opening, with the horizontal upper edge of each panel above the horizontal lower edge of each respective panel, and the horizontal lower edge of the bottom panel is located in the lowermost position proximate to the horizontal bottom side of the door opening, the door is in the open position when the horizontal lower edge of the bottom panel is located in the uppermost position proximate to the horizontal header beam, with both the top panel and the bottom panel disposed above the middle panel and with the top panel, the middle panel, and the bottom panel forming a generally triangular shape in which the middle panel forms a bottom side of the generally triangular shape and the horizontal upper edge of the top panel is proximate to the horizontal lower edge of the bottom panel to form a top vertex of the generally triangular shape.

2. The combination of claim 1, wherein the mass of the top panel is equal to the mass of the bottom panel, and the mass of each panel is evenly distributed between its horizontal upper edge and its horizontal lower edge.

3. The combination of claim 1, wherein a length from the horizontal upper edge of the top panel to the horizontal lower edge of the top panel is equal to a length from the horizontal upper edge of the bottom panel to the horizontal lower edge of the bottom panel.

4. The combination of claim 1, wherein when the door is in the open position the middle panel lies in a horizontal plane.

5. The combination of claim 1, wherein the doorframe further comprises two vertical door jambs which are spaced apart from each other, the horizontal header beam extending between upper ends of the vertical door jambs, the doorframe further comprises two vertically extending tracks, with one of the vertically extending tracks mounted on each vertical door jamb, and the door comprises two guide members mounted on the middle panel, with one of the guide members being retained by each vertically extending track and vertically movable in the vertically extending track.

6. The combination of claim 1, further comprising an elongate tensioning member, the elongate tensioning member being mounted at one end proximate to the horizontal lower edge of the bottom panel of the door and engaged at the other end proximate to the horizontal header beam, wherein reducing the length of the elongate tensioning member between the lower edge of the bottom panel and the horizontal header beam draws the horizontal lower edge of the bottom panel from the lowermost position to the uppermost position, and moves the door from the closed position to the open position.

7. The combination of claim 6, wherein an electric motor provides mechanical energy to pull upwards on the elongate tensioning member.

8. The combination of claim 4, wherein a length from the horizontal upper edge of the middle panel to the horizontal lower edge of the middle panel is no more than twice the length from the horizontal upper edge of the top panel to the horizontal lower edge of the top panel.

9. The combination of claim 4, wherein when the door is in the open position, a structural load of the door on one side of the door opening balances a structural load of the door on the other side of the door opening.

10. The combination of claim 1, wherein when the door is in the open position, there is a net torque of 0 about the first hinge member pivotally connecting the horizontal upper edge of the top panel to the horizontal header beam.

11. The combination of claim 1 wherein in the open position the middle panel extends transversely through vertical plane of the door opening with a first of the horizontal upper edge of the middle panel and the horizontal lower edge of the middle panel disposed forward of the vertical plane of the door opening and a second of the horizontal upper edge of the middle panel and the horizontal lower edge of the middle panel disposed rearward of the vertical plane of the door opening.

12. The combination of claim 5 wherein the two guide members are each mounted to the middle panel on opposite side edges of the middle panel at corresponding horizontal locations intermediate the horizontal upper edge of the middle panel and the horizontal lower edge of the middle panel.

13. The combination of claim 2, wherein a length from the horizontal upper edge of the top panel to the horizontal lower edge of the top panel is equal to a length from the horizontal upper edge of the bottom panel to the horizontal lower edge of the bottom panel.

14. The combination of claim 2, wherein when the door is in the open position the middle panel lies in a horizontal plane.

15. The combination of claim 2, wherein the doorframe further comprises two vertical door jambs which are spaced apart from each other, the horizontal header beam extending between upper ends of the vertical door jambs, the doorframe further comprises two vertically extending tracks, with one of the vertically extending tracks mounted on each vertical door jamb, and the door comprises two guide members mounted on the middle panel, with one of the guide members being retained by each vertically extending track and vertically movable in the vertically extending track, and wherein the two guide members are each mounted to the middle panel on opposite side edges of the middle panel at corresponding horizontal locations intermediate the horizontal upper edge of the middle panel and the horizontal lower edge of the middle panel.

16. The combination of claim 15, wherein when the door is in the open position the middle panel lies in a horizontal plane.

17. The combination of claim 2, further comprising an elongate tensioning member, the elongate tensioning member being mounted at one end proximate to the horizontal lower edge of the bottom panel of the door and engaged at the other end proximate to the horizontal header beam, wherein reducing the length of the elongate tensioning member between the lower edge of the bottom panel and the horizontal header beam draws the horizontal lower edge of the bottom panel from the lowermost position to the uppermost position, and moves the door from the closed position to the open position.

18. The combination of claim 16, further comprising an elongate tensioning member, the elongate tensioning member being mounted at one end proximate to the horizontal lower edge of the bottom panel of the door and engaged at the other end proximate to the horizontal header beam, wherein reducing the length of the elongate tensioning member between the lower edge of the bottom panel and the horizontal header beam draws the horizontal lower edge of the bottom panel from the lowermost position to the uppermost position, and moves the door from the closed position to the open position.

* * * * *